US007513636B2

(12) United States Patent
Beasley

(10) Patent No.: US 7,513,636 B2
(45) Date of Patent: Apr. 7, 2009

(54) POINT OF SALE DISPLAY FOR LIGHTING FIXTURES

(75) Inventor: Daniel John Beasley, Bromsgrove (GB)

(73) Assignee: IQ Group Sdn Bhd, Pulau Penang (MY)

( * ) Notice: Subject to any disclaimer, the term of this patent is extended or adjusted under 35 U.S.C. 154(b) by 0 days.

(21) Appl. No.: 11/552,470

(22) Filed: Oct. 24, 2006

(65) Prior Publication Data

US 2007/0168207 A1 Jul. 19, 2007

Related U.S. Application Data

(63) Continuation-in-part of application No. 10/798,836, filed on Mar. 11, 2004, now Pat. No. 7,126,490.

(60) Provisional application No. 60/503,626, filed on Sep. 17, 2003.

(51) Int. Cl.
*F21V 33/00* (2006.01)

(52) U.S. Cl. ..... 362/125; 434/379; 434/367; 434/429; 40/657; 186/35; 186/36; 186/52

(58) Field of Classification Search ..... 362/125, 362/126, 132, 145, 253; 40/409, 657; 186/35, 186/36, 52; 434/365, 367, 379, 382, 401, 434/429, 430; 340/691.6
See application file for complete search history.

(56) References Cited

U.S. PATENT DOCUMENTS

| | | | | | |
|---|---|---|---|---|---|
| 3,945,467 | A | * | 3/1976 | Levitz | 186/35 |
| 4,735,290 | A | * | 4/1988 | Byrley | 186/52 |
| 5,368,486 | A | * | 11/1994 | Kurzman | 434/79 |
| 5,431,250 | A | * | 7/1995 | Schlamp | 186/55 |
| 6,039,576 | A | | 3/2000 | Gabig et al. | |
| 2003/0090369 | A1 | | 5/2003 | Albritton et al. | |

* cited by examiner

*Primary Examiner*—Laura Tso
(74) *Attorney, Agent, or Firm*—Botkin & Hall, LLP

(57) ABSTRACT

A plurality of lighting fixtures with interchangeable sensors and transmitters are displayed for sale to the consuming public such that a customer of such a display may easily choose a specific lighting fixture and combine it with a specific sensor and/or transmitter enabling the customer to buy a lighting fixture meeting a customer's aesthetic and functional requirements.

4 Claims, 3 Drawing Sheets

POINT OF SALE DISPLAY FOR LIGHTING FIXTURES

CROSS REFERENCE TO RELATED APPLICATIONS

This application is a continuation-in-part of U.S. application Ser. No. 10/798,836, now U.S. Pat. No. 7,126,490, filed Mar. 11, 2004, and claims the benefit of U.S. provisional application Ser. No. 60/503,626, filed Sep. 17, 2003, the disclosures of which are hereby incorporated by reference.

BACKGROUND OF THE INVENTION

1. Field of the Invention

The invention relates to a point of sale display which will have specific, but not limited, application to the sale of lighting fixtures.

2. Description of the Background of the Invention

A lighting fixture can be an expression of an owner's personality. In order to satisfy a broad range of users, lighting fixtures often come in different styles, including different shapes and appearances. It has been common in the industry to manufacture and retail stock for controlled lighting fixtures with sensor and transmitter modules and uncontrolled lighting fixtures separately. A retailer is required to maintain a large stock of many different lighting fixtures, covering a wide spectrum of combinations of both controlled and uncontrolled models. This can be onerous to the retailer's operating costs and confusing to a consumer, having to make a decision on the purchase of a controlled or uncontrolled lighting fixture from a variety of options. Therefore, it would be advantageous to be able to present to a consumer a variety of optionally controlled lighting fixtures and separate sensor and transmitter modules that may be individually selected and then easily assembled by the consumer.

SUMMARY OF THE INVENTION

A controlled lighting fixture or similar item may be assembled from subcomponents such as by selecting an optionally controlled lighting fixture from a plurality of lighting fixtures and combining it with either a sensor module, a transmitter module or both.

The method of this invention of presenting lighting fixtures to a consumer includes providing a point of purchase display board near a parts bin in an area accessible to the consuming public. The display board displays different examples of the various combinable lighting fixture subcomponents from which the customer may choose. A supply of each subcomponent is stored in its own compartment in the storage bin. Identifiers associated with each subcomponent on the display board are placed near the displayed subcomponent and also on the corresponding compartment in the parts bin. The customer can retrieve the chosen subcomponent from the parts bin by matching the identifier on the display board with the identifier on the parts bin compartment, retrieving the appropriate subcomponent from the compartment.

An object of the present invention is to provide a new method of presenting various combinable subcomponents to a consumer in a manner allowing the consumer to choose an item from several possible combinations that pleases that consumer's unique aesthetic predilections.

Another object of the invention is to provide a line of lighting fixture parts including various lighting fixtures, sensor modules, and transmitter modules that may be easily interchanged to allow a purchaser to mix and match fixtures with optional control mechanisms.

DETAILED DESCRIPTION OF INVENTION

Figure 2:
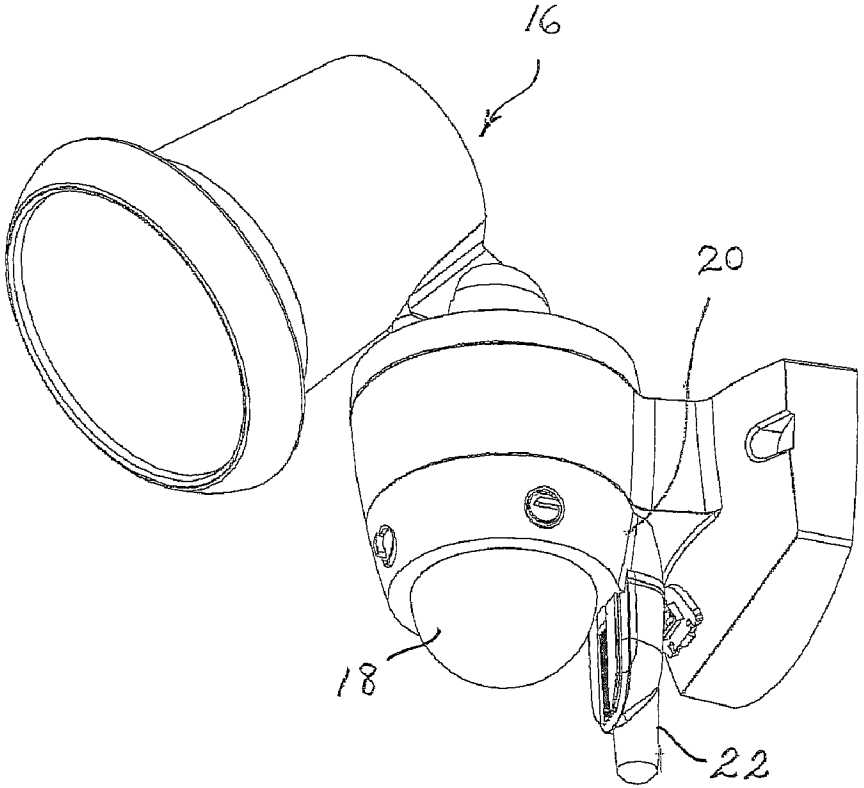
FIG. 2 is a perspective view of an additional embodiment of a lighting fixture and attachable sensor module and transmitter module.
Figure 1:
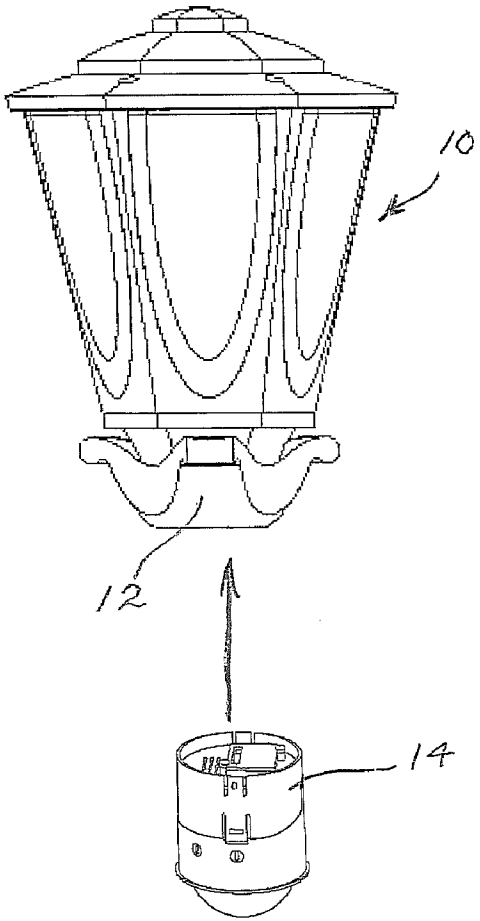
FIG. 1 is an exploded front elevational view of one embodiment of a lighting fixture and attachable sensor module.

A lighting fixture 10 includes a housing space 12 to receive a sensor module 14, as shown in FIG. 1. An additional embodiment of a lighting fixture 16 includes a sensor module 18 provided with a housing space 20 to receive a transmitter module 22, as shown in FIG. 2.

Figure 3:
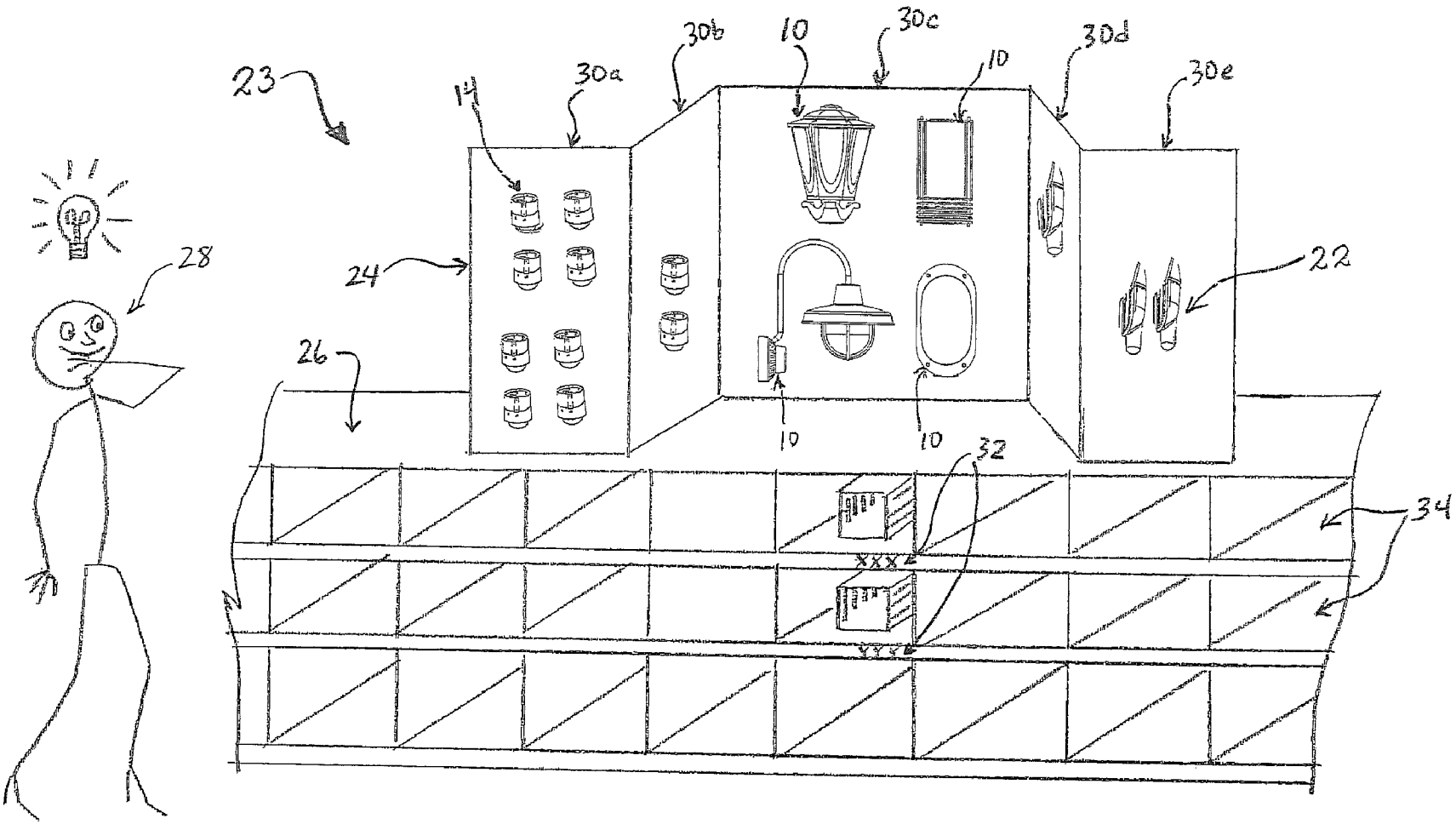
FIG. 3 depicts an embodiment of a display arrangement for selling the lighting fixtures and modules of FIGS. 1 and 2.

A point-of-purchase sales display 23 for use in a retail setting includes a product display board 24 and preferably an adjacent parts bin 26. Display board 24 is shown set up over parts bin 26 in an area where a customer 28 can access the display and parts bin. As shown in FIG. 3, a display board 24 may be divided into five main regions 30*a-e*, each region for displaying different subcomponents of a lighting fixture assembly. Regions 30*a-e* display various styles of lighting fixtures and various styles of both sensor and transmitter modules. Each region 30*a-e* preferably includes appropriate signage designating what subcomponents are displayed in that particular region. Each of the various lighting fixtures 10,16 displayed on the display board 24 is preferably supplied with electrical power so as to demonstrate the different capabilities of sensor modules 14,18 and transmitter module 22. An identification code 32 is preferably associated with each subcomponent displayed on the display board 24.

Parts bin 26 includes a plurality of compartments 34 corresponding to the number of different parts available as indicated on the display board 24. Each compartment 34 is labeled with an identification code 32 that corresponds with one of the identification codes 32 on the display board 24. Each compartment contains the same subcomponent displayed on the display board 24 associated with that identifier.

Figure 4:
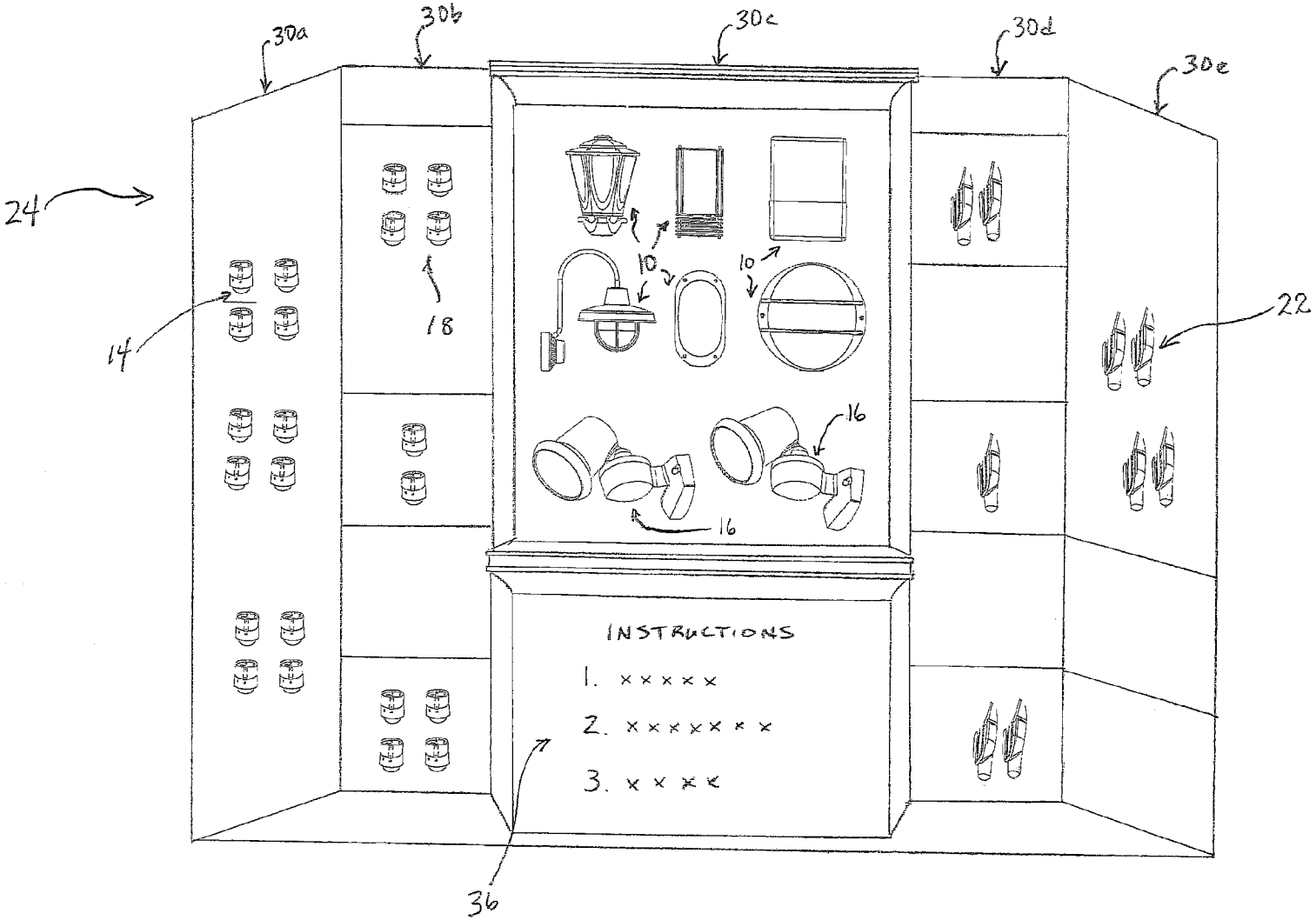
FIG. 4 depicts an embodiment of a display board for use in the display arrangement of FIG. 3.

As shown in FIG. 4, the display board 24 also includes a set of instructions 36 visible and readable by a consumer 28 standing near the display 23. Instructions 36 detail a set of distinct steps on how to use the display. The consumer is first directed to choose a first subcomponent, such as a lighting fixture 10,16. The consumer is then directed to select a second subcomponent, if desired, such as a sensor module 14,18. The consumer is then directed to select one or more additional subcomponents, if desired, such as a transmitter module 22. These instructions, along with the hereinbefore described sales display 23, enable a consumer to simply and easily select an uncontrolled or controlled lighting fixture.

A method of presenting a lighting fixture 10,16 with interchangeable subcomponents for sale to the retail public includes using the sales display 23 in conjunction with lighting fixtures 10,16 in a publicly accessible retail setting. Initially, a retailer sets up the sales display 23 in an area of a retail store where a consumer 28 can easily conceive the display board 24, activate sensor modules 14,18 and transmitter module 22, and access compartments 34 in parts bin 26. For example, a retailer might set up the sales display 23 in an open aisle area accessible to the public in a retail store. The retailer may then stock each of the compartments 34 with the appropriate subcomponents corresponding to the subcomponents shown in the display 23 as hereinbefore described. A consumer 28 interested in purchase is allowed to approach the display 23 are the consumer may read the instructions 36. The consumer 28 then follows the instructions and selects the subcomponent or suhcomponents he or she wishes to purchase. The consumer 28 then reads the identification code 32 on the display board 24 associated with the selected subcomponent or subcomponents, identifies the appropriate compartment 34 with the same identification code or codes 32, and removes one of the corresponding subcomponents contained within the compartment 34 for each selected subcomponent.

The foregoing description discloses and describes merely exemplary methods and embodiments of the present invention. As will be understood by those familiar with the art, the invention may be embodied in other specific forms and utilize other materials without departing from the spirit or essential characteristics thereof. Accordingly, the disclosure of the present invention is intended to be illustrative, but not limiting, of the scope of the invention, which is set forth in the following claims.

What is claimed is:

1. A method of presenting for sale a plurality of lighting fixture subcomponents wherein the subcomponents are able to be assembled into a lighting fixture, at least some of the subcomponents having a plurality of interchangeable forms, the method comprising:

a) providing a point-of-purchase display, the display including a representative sample of each form of each subcomponent for sampling by a consumer;

b) separating each representative sample from every other representative sample upon the display to provide a visual comparison for the consumer;

c) providing a bin with said display containing a said form of each subcomponent;

d) allowing the consumer to access the display wherein the consumer selects a preferred assembly by i) selecting one or more forms of one subcomponent from said bin corresponding to the representative samples on the display; and ii) selecting one or more forms of one or more other subcomponent from said bin corresponding to representative samples on the display;

e) then connecting said selected forms to complete said lighting fixture.

2. The method of claim 1 wherein each representative sample of each form of each subcomponent in the point-of-purchase display includes a product identifier.

3. The method of claim 1 including the further step of using the product identifier associated with each selected form to purchase the form.

4. The method of claim 3 wherein the subcomponents include a lighting fixture, a sensor module, and a transmitter module, each available in a plurality of interchangeable forms.

* * * * *